US012416164B2

(12) United States Patent
Gervasoni et al.

(10) Patent No.: US 12,416,164 B2
(45) Date of Patent: Sep. 16, 2025

(54) PANEL CONNECTION SYSTEM

(71) Applicant: Swisspearl Group AG, Niederurnen (CH)

(72) Inventors: Aristide Gervasoni, Walenstadt (CH); Oliver Peter Günter Millon, Wädenswil (CH); Tassilo Folker Rinder, Mollis (CH); André Felipe Toresan Eigenmann, Glarus Nord (CH); Martin Trachsler, Engi (CH); Carsten Zanders, Mollis (CH)

(73) Assignee: Swisspearl Group AG, Niederurnen (CH)

( * ) Notice: Subject to any disclaimer, the term of this patent is extended or adjusted under 35 U.S.C. 154(b) by 222 days.

(21) Appl. No.: 18/031,478

(22) PCT Filed: Oct. 15, 2021

(86) PCT No.: PCT/EP2021/078561

§ 371 (c)(1),
(2) Date: Apr. 12, 2023

(87) PCT Pub. No.: WO2022/084167

PCT Pub. Date: Apr. 28, 2022

(65) Prior Publication Data

US 2023/0374792 A1 Nov. 23, 2023

(30) Foreign Application Priority Data

Oct. 19, 2020 (WO) ..... PCT/EP2020/079377

(51) Int. Cl.
*E04B 2/00* (2006.01)
*E04F 13/08* (2006.01)

(52) U.S. Cl.
CPC ..... *E04F 13/0892* (2013.01); *E04F 2201/00* (2013.01); *E04F 2201/05* (2013.01)

(58) Field of Classification Search
CPC ..... E04F 2201/00; E04F 2201/05; E04F 13/0733
(Continued)

(56) References Cited

U.S. PATENT DOCUMENTS 3,113,358 A * 12/1963 Zell ..... F16B 12/20 52/285.3
3,490,797 A * 1/1970 Platte ..... F16B 5/07 403/231
(Continued)

FOREIGN PATENT DOCUMENTS

CN 108360786 A 8/2018
DE 93 14 313 U1 12/1993
(Continued)

OTHER PUBLICATIONS

International Search Report for PCT/EP2021/078561 dated Nov. 18, 2021.

*Primary Examiner* — Basil S Katcheves
(74) *Attorney, Agent, or Firm* — Sughrue Mion, PLLC

(57) ABSTRACT

Panel connection system for the corner connection of two panels which are arranged at an angled inclination to one another, having a first connecting element having a bearing portion with at least one support surface, by which the connecting element is supported on one of the two panels, and a leg portion which projects at an angled inclination from the bearing portion and which has at least one first engaging structure, and a second connecting element having a bearing portion having at least one support surface, by which the connecting element is supported on the other of the two panels, and having at least one second engaging structure which is situated opposite the support surface, wherein the at least one first engaging structure of the first connecting element is designed for engagement in the at
(Continued)

least one second engaging structure of the second connecting element.

20 Claims, 13 Drawing Sheets

(58) Field of Classification Search
USPC ..... 52/656.1
See application file for complete search history.

(56) References Cited

U.S. PATENT DOCUMENTS 3,618,993 A * 11/1971 Platte ..... F16B 12/26 52/285.3
3,675,955 A * 7/1972 Hajduk ..... F16B 12/26 217/65
5,437,130 A * 8/1995 Raynak ..... E06B 1/52 52/656.1
5,720,571 A * 2/1998 Frobosilo ..... E04B 2/96 403/231
6,000,179 A * 12/1999 Musculus ..... E04B 2/7425 403/231
6,213,679 B1 * 4/2001 Frobosilo ..... E04B 2/96 403/14
6,481,177 B1 * 11/2002 Wood ..... F16B 12/50 403/231
7,137,227 B2 * 11/2006 Franz ..... E04B 1/38 52/712
8,028,489 B1 * 10/2011 Lawrence ..... E06B 3/9641 52/204.58
9,528,315 B2 * 12/2016 Kim ..... E06B 3/9765
12,158,008 B2 * 12/2024 Ochi ..... E04F 13/0805
2006/0156679 A1 * 7/2006 Pierret ..... A44B 17/00 52/698

FOREIGN PATENT DOCUMENTS

DE 195 14 378 A1 10/1996
DE 203 19 664 U1 5/2005
KR 10-1327534 B1 11/2013

* cited by examiner

PANEL CONNECTION SYSTEM

CROSS REFERENCE TO RELATED APPLICATIONS

This application is a National Stage of International Application No. PCT/EP2021/078561 filed Oct. 15, 2021, claiming priority based on International Application No. PCT/EP2020/079377 filed Oct. 19, 2020.

TECHNICAL FIELD

The present invention relates to a panel connection system for the connection of two panels inclined at an angle to one another as claimed in claim 1, and to an assembly having two panels and said panel connection system, and to a method for installing the assembly.

PRIOR ART

Façade cladding systems having panels are known from the prior art. Such panels are joined at the corners of buildings in different ways.

In DE 93 14 313 U1 it is proposed to provide the panels with mitered edges in the corner region and to connect the panels together using an angle piece.

DE 195 14 378 A1 likewise discloses an angle piece for the connection of two panels.

DE 203 19 664 U1 discloses various embodiments of a two-part angle piece, wherein the two parts can be fixedly connected together. The connecting parts of DE 203 19 664 U1 are configured such that the connecting parts are displaceable relative to one another transverse to the two legs of the connecting parts.

A disadvantage of the systems known from the prior art is the way in which they are installed. From a substructure on which the panels are to be installed, all the systems require a comparatively large amount of space for installation. This is a disadvantage in particular when there is also a scaffold in front of the substructure, which in most cases is erected very close to the substructure for reasons of occupational safety.

DESCRIPTION OF THE INVENTION

Proceeding from this prior art, one object of the present invention is to provide a panel connection system for the connection of two panels arranged at an angle to one another, which overcomes the disadvantages of the prior art. A particularly preferred object is to provide a panel connection system which can be installed even in confined conditions.

This object is achieved by the panel connection system as claimed in claim 1. According to that claim, a panel connection system for the corner connection of two panels arranged inclined at an angle, in particular at a right angle, to one another comprises a first connecting element comprising a mounting portion having at least one contact surface with which the connecting element lies directly or indirectly against one of the two panels, and a leg portion projecting from the mounting portion in a manner inclined at an angle and having at least one first engagement structure, and a second connecting element comprising a mounting portion having at least one contact surface with which the connecting element lies directly or indirectly against the other of the two panels, and having at least one second engagement structure situated opposite the contact surface.

The at least one first engagement structure of the first connecting element is configured for engagement into the at least one second engagement structure of the second connecting element. In an engaged position, the two engagement structures engage into one another in a mechanically fixed manner, such that the two panels are fixedly connected together by way of the engagement structures. The two engagement structures are configured such that the two connecting elements can be connected together by way of a connecting movement along a longitudinal axis, which longitudinal axis is inclined at an angle to the contact surface of the first connecting element.

The connection of the two connecting elements along said longitudinal axis has the advantage that the two panels can be connected together at a small distance from a substructure. The panels are here displaced in their panel plane and toward one another, which is particularly advantageous.

In one embodiment, the two panels are at an angle of 90° to one another. The panels here lie directly against the contact surface.

In another embodiment, the panels are inclined at an angle of from 78° to 102° to one another. At least one of the two panels here lies against the contact surface indirectly. For indirect contact, a wedge element described below is provided.

The longitudinal axis extends along a straight line. A straight line is understood as being a straight line in the geometrical sense.

The first engagement structure and the second engagement structure are configured to be complementary to one another, so that the above-mentioned engagement is made possible.

The panel connection system can be used for various applications. Particularly preferably for façade panels or interior cladding. The panel connection system is typically fastened to the rear side of the panels.

The panel is preferably a fiber-cement panel. Fiber-cement panels typically consist of cement and high tensile strength fibers. Such panels are typically produced by the Hatschek process. The panel can, however, also be made of a different material. Examples which may be mentioned here include wood, natural slate, natural stone (e.g. granite, gneiss, quartzite, porphyry, sandstone or marble), ceramics (e.g. porcelain stoneware, stoneware, terracotta), fiber-reinforced fine-grained concrete (e.g. Cemfor, Rebeton), fiber-reinforced slate/stone chippings (e.g. Cottostone), fiber-reinforced laminates, metals (e.g. coated steel sheets, copper-titanium-zinc, aluminum, copper or chrome steel), layered composite materials (laminates, e.g. Alucobond), glass, or fully plastered supporting panels.

In principle, homogeneous, organic and inorganic materials or combinations, such as fiber composite structures or layered composite structures, can be used.

The geometric dimensions, such as thickness, format, or the appearance, such as the color, of the panel are independent of the fastening concept proposed herein. Likewise, the visible side can be provided with esthetic elements, such as paints or surface structures.

Preferably, each of the two connecting elements has at least one sliding surface in the region of the engagement structures, wherein the sliding surfaces are arranged such that the two connecting elements are in contact with one another by way of the sliding surfaces during connection. Accordingly, there is a sliding movement between the two connecting elements during the connection process.

The sliding surfaces provide a guide for the two connecting elements. During installation, the two connecting elements slide toward one another over the sliding surfaces in the direction of the longitudinal axis, such that the engagement structures are moved toward one another.

Preferably, two engagement structures are provided per connecting element and thus form two pairs of engagement structures. A pair of engagement structures is provided by a first engagement structure and a second engagement structure. The arrangement of two pairs of engagement structures has the advantage of a properly guided and above all durable connection between the two connecting elements.

Preferably, a first pair of engagement structures is arranged in the region of the transition from the mounting portion to the leg portion, and a second pair of engagement structures is arranged in the region of a free end of the leg portion.

Preferably, one of the engagement structures is in the form of a receiver and the other of the engagement structures is in the form of a lug, wherein the lug can be inserted into the receiver along the longitudinal axis.

The receiver is preferably so configured that the lug comes to lie substantially wholly in the receiver.

Preferably, the receiver and/or the lug has a latching element which permits mechanically fixed latching of the two interengaging engagement structures.

Preferably, the engagement structure having the latching element is interrupted by at least one slot extending in the longitudinal direction. The slot has the advantage that the latching force of the latching element can better be dimensioned.

Preferably, the lug engages into the receiver substantially without play.

In a particularly preferred embodiment, there are exactly two pairs of engagement structures. One pair has said latching elements. The other pair does not have latching elements, the two engagement structures here engage into one another without latching together. Preferably, the pair of engagement structures without the latching elements is arranged in the corner region or mitered region of the two panels. Precise positioning of the two panels in the region of the corners can thus be achieved. Said pair of engagement structures without the latching elements is further so configured that the engagement structures engage into one another up to their limit.

Preferably, one of the two connecting elements has a screw opening which has an aperture that is open to the other connecting element, wherein a screw can be screwed into the screw opening, such that the screw exerts a clamping force on both connecting elements.

The aperture extends through the side wall, which surrounds the screw opening. In the region of the aperture, the screw opening is delimited by a wall region of the other connecting element. The screw is preferably a self-tapping metal screw which screws into the wall of the screw opening and said wall region.

Preferably, the mounting portion has at least one fastening opening through which a fastening screw connected to the panel can be guided, such that the connecting element can be fixedly connected to said panel.

Particularly preferably, two fastening openings situated spaced apart from one another are provided per connecting element.

Preferably, the leg portion has one slot per fastening screw, which creates a passage region for the at least one fastening screw of the second connecting element on connection of the two connecting elements.

Preferably, the leg portion is supported on the mounting portion by way of a support portion, wherein the support portion is arranged opposite the contact surface and the engagement structure. The support portion is preferably strut-like and acts against a force which would cause relative bending between the leg portion and the bearing portion.

Particularly preferably, the support portion is connected by means of an intermediate leg to a side wall surrounding the screw opening. The stability of the first connecting element can thus be increased further.

Preferably, there are two contact surfaces arranged spaced apart from one another per connecting element. Preferably, the contact surfaces are in the form of strip-shaped contact surfaces.

Preferably, one of the contact surfaces of the first connecting element and/or of the second connecting element is configured with a lateral edge, wherein the lateral edge defines an intersection line for the rear sides of the two panels. In the connected state, the lateral edge comes to lie in the corner region of the two panels, whereby a precise alignment of the two panels can be achieved.

Preferably, the first and second connecting elements are produced from a metal profile, in particular an aluminum profile, wherein the metal profile is processed by a machining operation after it has been cut to length.

An assembly comprises at least one panel connection system as described above and two panels, wherein the first connecting element is mounted on the rear side of one panel and the second connecting element is mounted on the rear side of the other panel.

The two panels with their connecting elements can be moved toward one another by a relative movement along the longitudinal axis, wherein engagement of the respective connection structures takes place as a result.

Preferably, the two panels can be brought into contact with one another by way of their facing end faces, wherein the end faces are in the form of mitered faces.

Preferably, multiple panel connection systems are provided in each case. The distance between the mentioned panel connection systems can be between 20 and 100 centimeters. In the case of panels with greater rigidity, a greater distance can be chosen than in the case of panels with lower rigidity.

Preferably, the angle between the contact surface of the first connecting element and the contact surface of the second connecting element is substantially 90°, such that, when the connecting elements lie directly against the respective panel, the two panels are arranged at a right angle to one another.

In a further embodiment, the panel connection system further comprises at least one wedge element which can be arranged or is arranged on at least one of the mentioned contact surfaces and at least one of the rear sides of the panel such that the at least one contact surface lies against the rear side of the panel indirectly by way of the wedge element and the panels are inclined at an angle to one another that is other than a right angle.

Preferably, the further embodiment is characterized in that

- the wedge element has a latching portion with which the wedge element can be connected to the connecting element in question by way of a latching connection; and/or
- the wedge element has a contact surface with which the wedge element lies against the panel in question; and/or
- the wedge element is made of a metal, such as aluminum, or a plastics material, such as polypropylene; and/or
- the mentioned angle is between 91° and 102° or between 78° and 89°.

A method for installing an assembly as described above is characterized in that, in a first step, the first and second connecting elements are connected to the respective panel and in that, in a subsequent step, the two panels with the connecting elements are moved relative to one another by way of a connecting movement along a longitudinal axis, such that the at least one first engagement structure of the first connecting element engages into the at least one second engagement structure of the second connecting element. The connecting elements are preferably connected directly or, where the wedge element is present, indirectly to the panel in question.

Further embodiments are indicated in the dependent claims.

BRIEF DESCRIPTION OF THE DRAWINGS

Preferred embodiments of the invention will be described in the following with reference to the drawings, which serve merely for explanatory purposes and are not to be interpreted as being limiting. In the drawings.

DESCRIPTION OF PREFERRED EMBODIMENTS

Figure 1A:
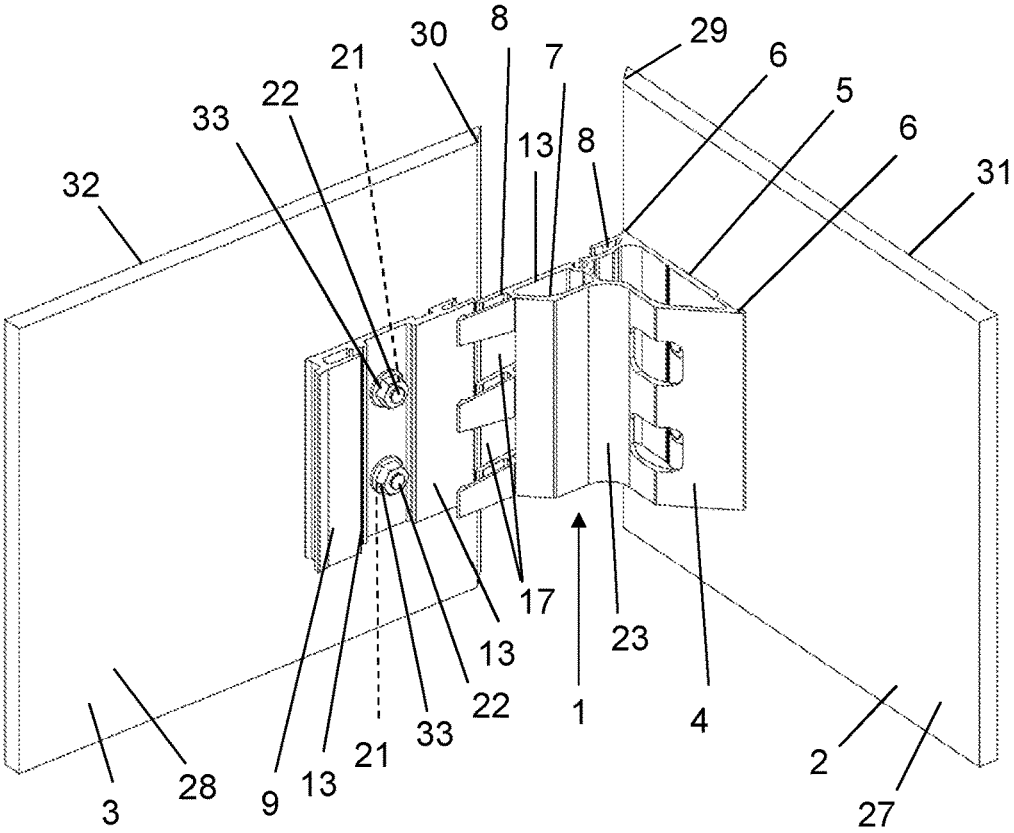
FIGS. 1*a* and 1*b* are a perspective view and a plan view of a panel connection system according to the invention having two panels prior to connection.

In the figures, a panel connection system 1 for the corner connection of two panels 2, 3 arranged inclined at an angle, in particular at a right angle, to one another is shown. The panels 2, 3 are, for example, façade cladding panels or panels which are to be arranged in a different way. The panels 2, 3 with the panel connection system 1 are referred to as an assembly. The panels 2, 3 typically stand vertically but may also be oriented horizontally and vertically or in any other spatial position.

The panels each have a visible side 31, 32 and a rear side 27, 28. The rear sides 27, 28 are each oriented against a substructure or against a house wall or the like. The panels further have end faces 29, 30. In the installed position, the end faces 29, 30 of the two panels 2, 3 are oriented toward one another. Particularly preferably, the end faces 29, 30 are mitered so that the two end faces 31, 32 lie against one another such that from outside a defined edge 38 can be created in the region of the corner 39 of the two panels 2, 3.

The panel connection system 1 comprises a first connecting element 4 and a second connecting element 9. The first connecting element 4 is fixedly connected to the panel 2, and the second connecting element 9 is fixedly connected to the panel 3. Depending on the size of the panels, multiple connection systems are to be used.

The first connecting element 4 comprises a mounting portion 5 having at least one contact surface 6. The connecting element 4 lies with the at least one contact surface 6 against the rear side 27 of the panel 2. The first connecting element 4 further comprises a leg portion 7 which projects in a manner inclined at an angle, here at a right angle, from the mounting portion 4. The leg portion 7 has at least one first engagement structure 8. In the embodiment shown, two first engagement structures 8 are arranged spaced apart from one another.

The second connecting element 9 comprises a mounting portion 10 having at least one contact surface 11. The second connecting element 9 lies with the at least one contact surface 11 against the rear side 28 of the panel 3. The second connecting element 9 further comprises at least one engagement structure 12 situated opposite the contact surface 11. In the embodiment shown, two second engagement structures 12 are arranged spaced apart from one another.

In FIGS. 1 to 10, the connecting elements 4, 9 are in direct contact with the respective panels 2, 3. FIGS. 11 to 14 show a further embodiment in which the connecting elements 4, 9 are in indirect contact with the respective panel 2, 3. For indirect contact, a wedge element 43 is arranged between the panel in question and at least one of the connecting elements 4, 9.

The two engagement structures 8, 12 are configured such that the two connecting elements 4, 9 can be connected together by way of a displacement movement V. The displacement movement V extends along a straight longitudinal axis L. The longitudinal axis L extends inclined at an angle, here at a right angle, to the contact surface 6 of the first connecting element 4, or parallel to the at least one contact surface 11 of the second connecting element 9. Typically, the longitudinal axis L is accordingly parallel to the rear side 28 of the panel 3 and at a right angle to the rear side 27 of the panel 2.

Figure 1B:
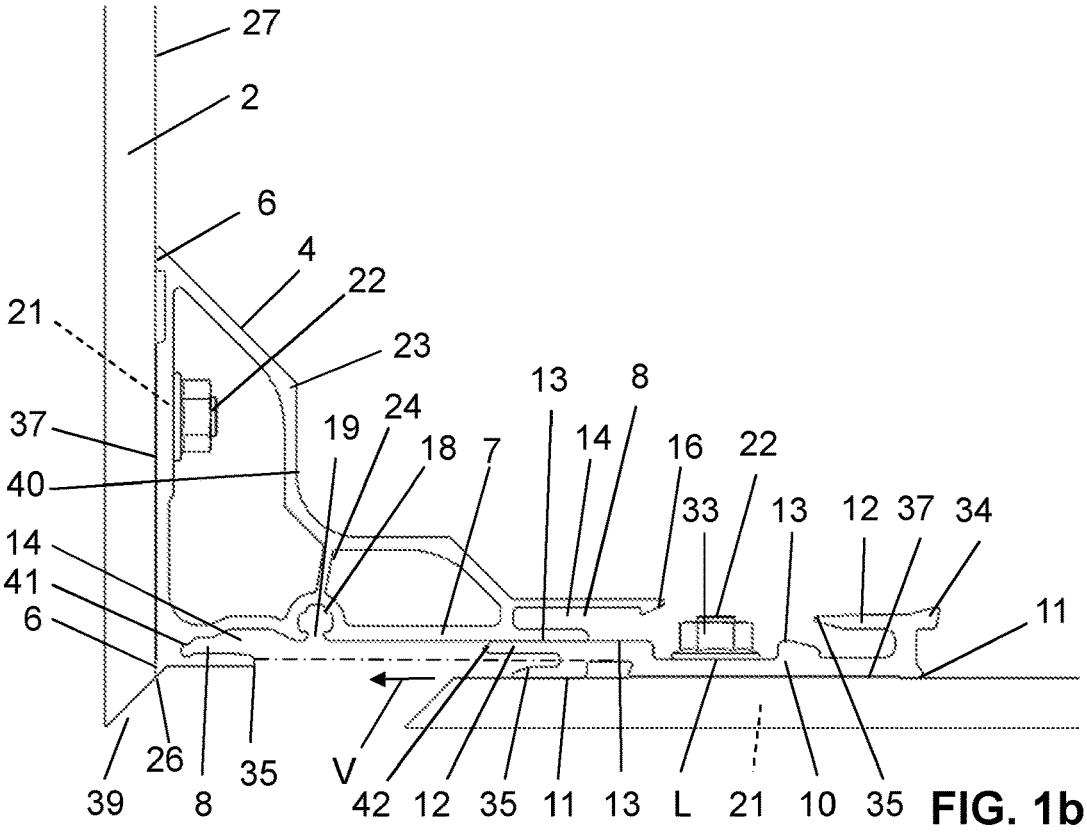

In FIGS. 1*a* and 1*b*, the panel connection system 1 with the two panels 2, 3 is shown in a position prior to the actual connection. Starting from this position, the two panels 2, 3 are connected together by means of the first connecting element 4 and the second connecting element 9 by way of the displacement movement V along the longitudinal axis L.

Figure 2A:
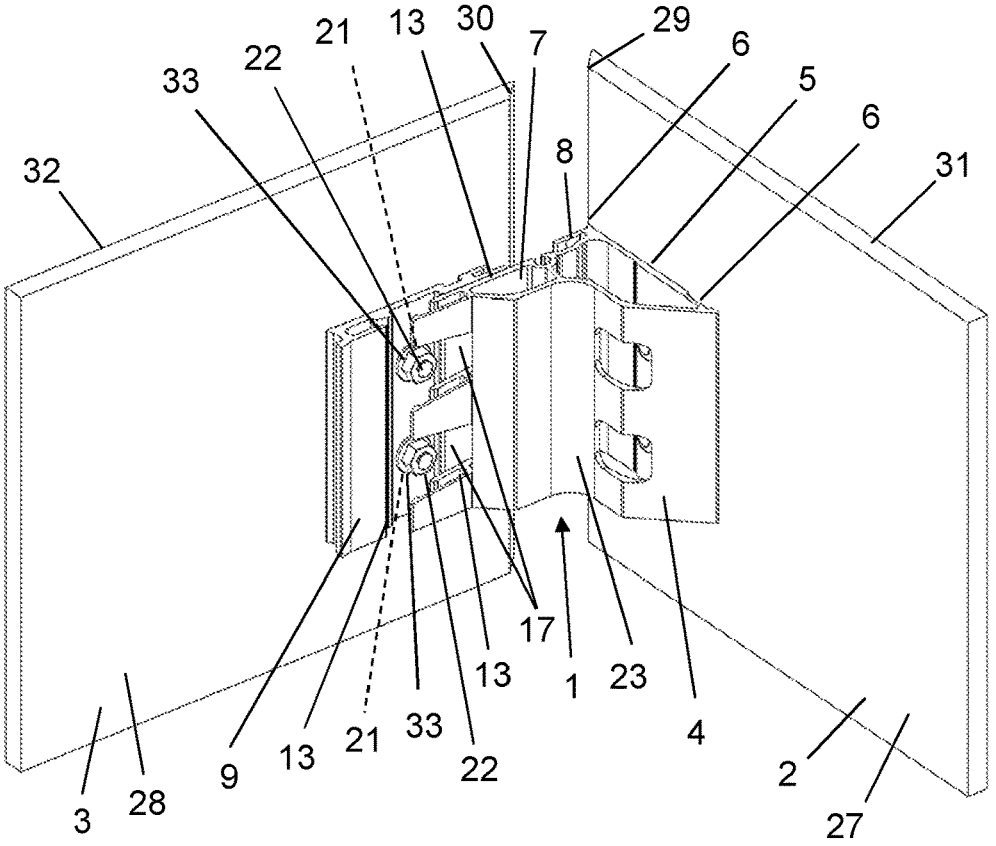
FIGS. 2*a* and 2*b* are the views according to FIG. 1*a*/1*b* during connection.
Figure 2B:
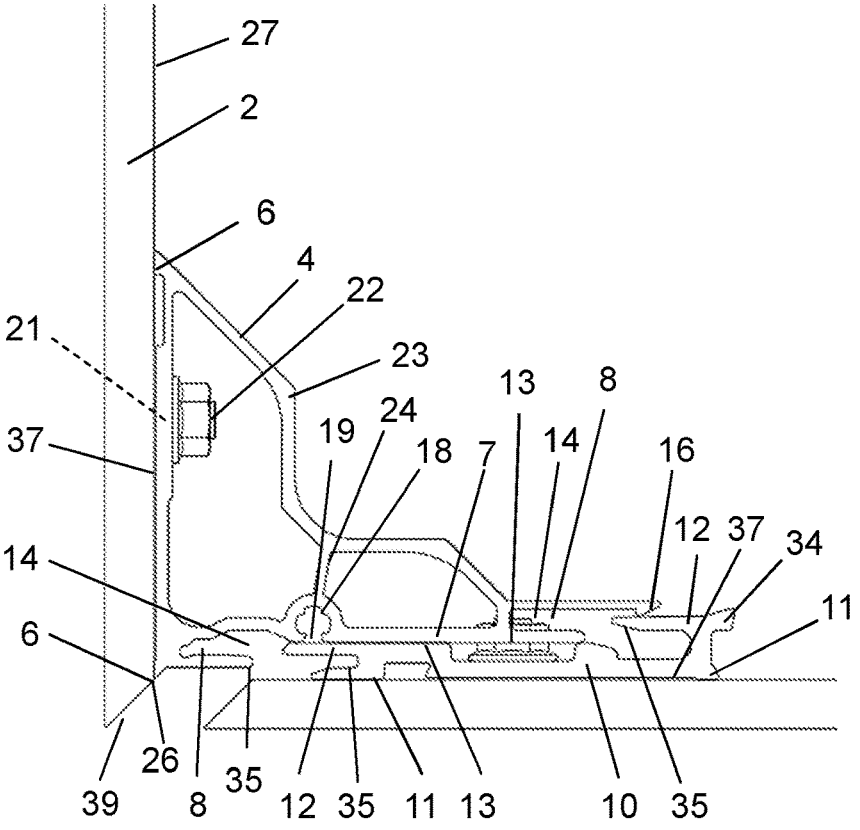

FIGS. 2*a* and 2*b* show the progression of the displacement movement V relative to FIGS. 1*a* and 1*b*, wherein the two panels 2, 3 are shown moved closer to one another. The engagement structures 8, 9 are here about to come into mechanical engagement with one another.

Figure 3:
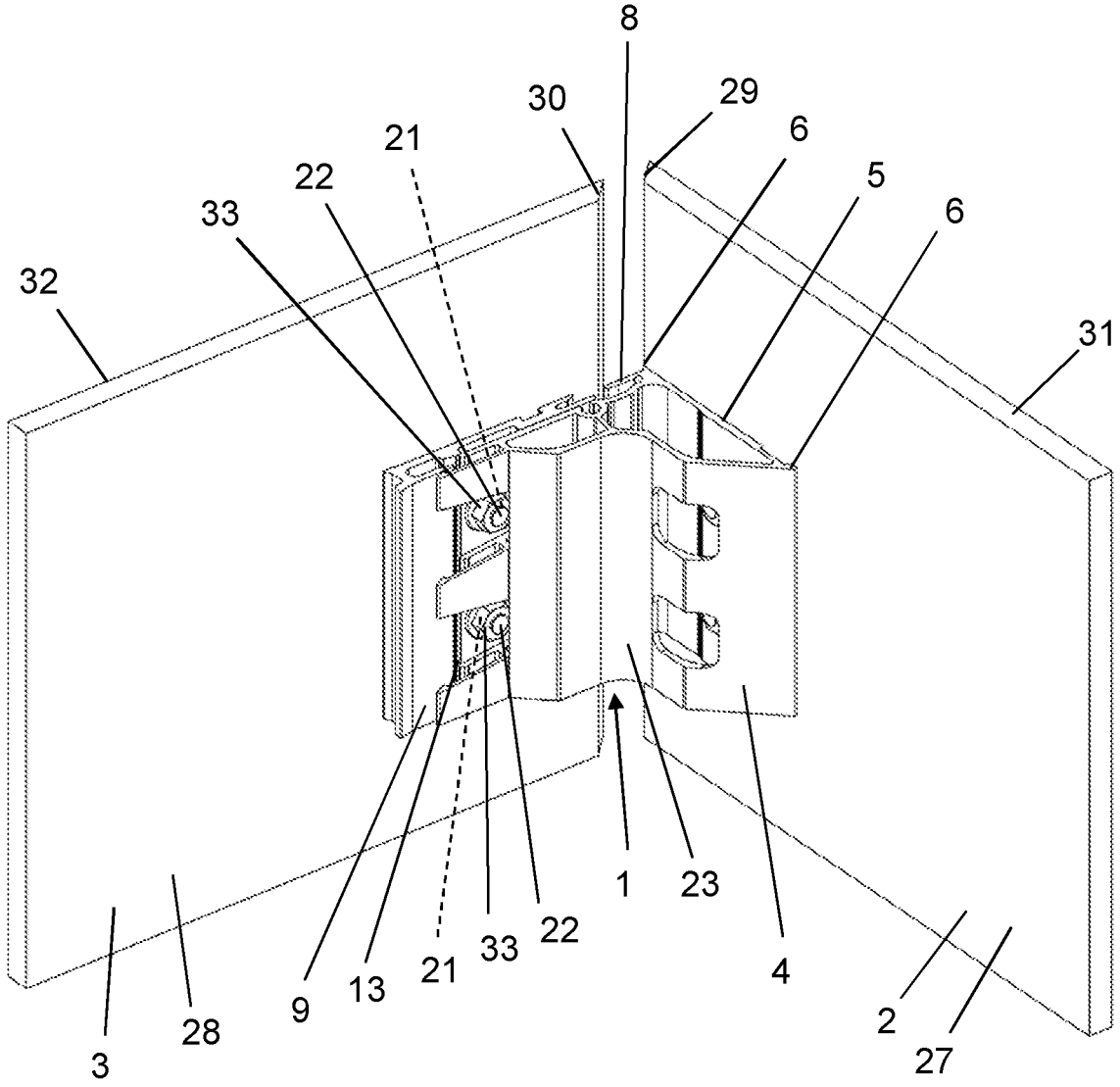
FIG. 3 is a further perspective view of the preceding figures during installation.

FIG. 3 is a further perspective view of the displacement.

Figure 4A:
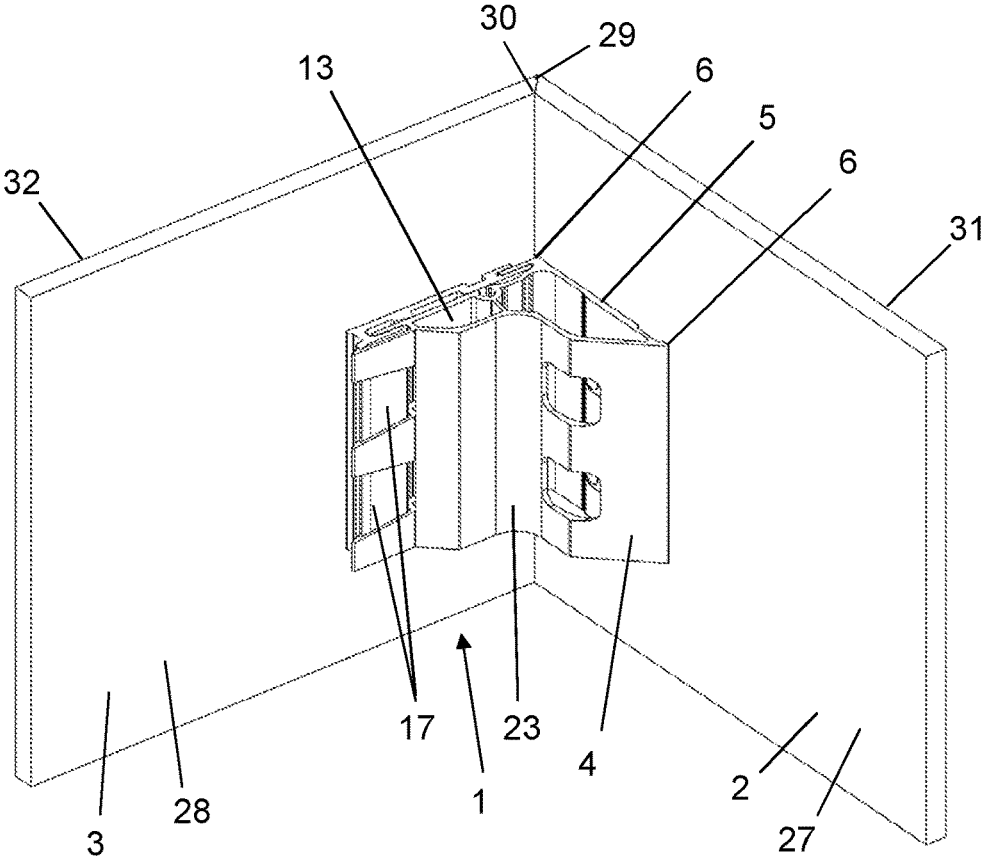
FIGS. 4*a* and 4*b* are the views according to FIG. 1*a*/1*b* after connection has taken place.
Figure 4B:
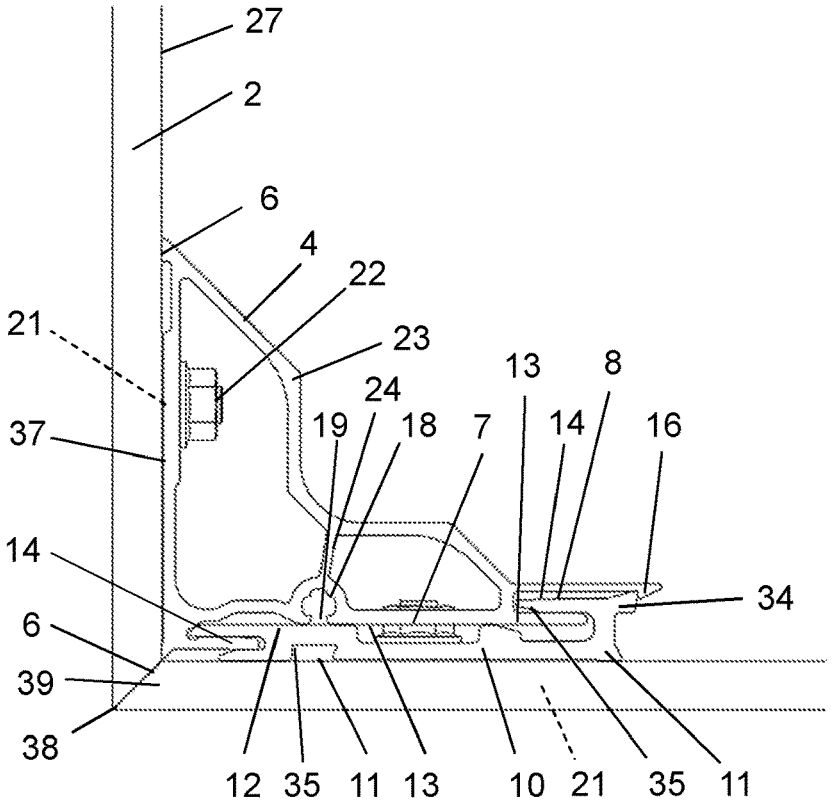

FIGS. 4*a* and 4*b* then show the end position. The two panels 2, 3 are in contact by way of their end faces 29, 30 or are at a very small distance from one another. Furthermore, the engagement structures 8 of the first connecting element 4 and the engagement structures 12 of the second connecting element 9 are in mechanically fixed engagement with one another and the two panels 2, 3 are thus connected together by way of the engagement of the engagement structures 8, 12.

It is further apparent from FIGS. 1*a* to 4*b* that the mounting portion 5 of the first connecting element 4 and the mounting portion 10 of the second connecting element 9 each have at least one fastening opening 21. In the embodiment shown, each of the mounting portions 5, 10 has two fastening openings 21. By way of these fastening openings 21, the connecting element 4, 9 can be fixedly connected to the respective panel 2, 3. In the embodiment shown, a fastening screw 22 connected to the panel 2, 3 has been guided through the fastening opening 21 such that the connecting element 4, 9 can be fixedly connected to said panel 2, 3. In the embodiment shown, a nut 33 is further provided for the connection, which nut is screwed onto the fastening screw 22 and thus presses the connecting element 4, 5 in question against the rear side 27, 28 of the panel 2, 3. Other types of connection are also conceivable. For example, it would be conceivable that the two connecting elements 4, 9 are adhesively bonded to the panels 2, 3.

The leg portion 7 of the first connecting element 4 has one slot 17 per fastening screw 22.

The slot 17 creates a passage region for the fastening screw 22 on connection of the two connecting elements 4, 9. This passage is shown accordingly in FIGS. 2*a* and 3. It can clearly be seen here how the fastening screw 22, on connection by way of the displacement movement V along the longitudinal axis L, correspondingly enters the slot and is guided through the slot 17.

With regard to the displacement movement V, it is advantageous if the first connecting element 4 and the second connecting element 9 have corresponding sliding surfaces 13. The two connecting elements 4, 9 each have at least one sliding surface 13 in the region of the engagement structures 8, 12. FIG. 1*b* shows the first contact of the sliding surfaces 13 of the two connecting elements 4, 9. The sliding surfaces 13 serve to allow the two connecting elements 4, 9 to be in contact with one another during connection by way of the displacement movement V by way of the sliding surfaces 13, so that a sliding displacement movement V can be achieved. FIG. 2*b* shows the further progression of the displacement movement V. It can easily be seen here that a further sliding surface 13 on the second connecting element 9 comes into contact with the sliding surface 13 of the first connecting element 4.

As mentioned, the first connecting element 4 has two first engagement structures 8, and the second connecting element 9 has two second engagement structures 12. Two pairs of engagement structures 8, 12 are thus formed. A first pair of engagement structures 8, 12 is arranged in the region of the corner 39 of the two panels 2, 3. A second pair is arranged at the end of the leg portion 7, that is to say spaced apart from said corner 39. By means of this spaced apart arrangement of the two pairs of engagement structures 8, 12, it can be achieved that the two connecting elements 4, 9 are stably connected together.

In the embodiment shown, the two engagement structures 8 on the first connecting element are each in the form of a receiver. The engagement structures 12 on the second connecting element 9 are each in the form of a lug 15. The lug 15 can be inserted along the longitudinal axis L into the receiver 14 and, as is shown in FIGS. 4*a* and 4*b*, is accommodated substantially completely in the receiver.

In the embodiment shown, one of the receivers 14, namely the receiver 14 arranged spaced apart from the above-mentioned corner 39 of the two panels 2, 3, has a latching element 16. The latching element 16 allows mechanically fixed latching of the two interengaging engagement structures 8, 12. In the embodiment shown, the lug 15 has a corresponding counter-piece 34, on which the latching element 16 correspondingly latches. The other of the two pairs of engagement structures 8, 12 does not have a latching structure in the embodiment shown. In the case of the other of the two pairs, a lug 41 engages into a receiver 42. The lug 41 and the receiver 42 are dimensioned such that the lug 41 abuts the base of the receiver 42. Exact positioning of the two connecting elements 4, 9 and thus also of the two panels 2, 3 is thereby achieved. Preferably, both pairs of engagement structures 8, 12 are so positioned that, when the lug 41 abuts the base of the receiver 42, the latching element 16 latches on the counter-piece 34. In this position, the two connecting elements 4, 9 are preferably situated without play relative to one another with respect to a movement in the direction of the longitudinal axis L.

Preferably, the engagement structures 8, 12 engage into one another substantially without play.

The receiver 14 and/or the lug 15 can further have beveled portions 35, which correspondingly facilitates the connection between the receiver 14 and the lug 15.

Figure 5:
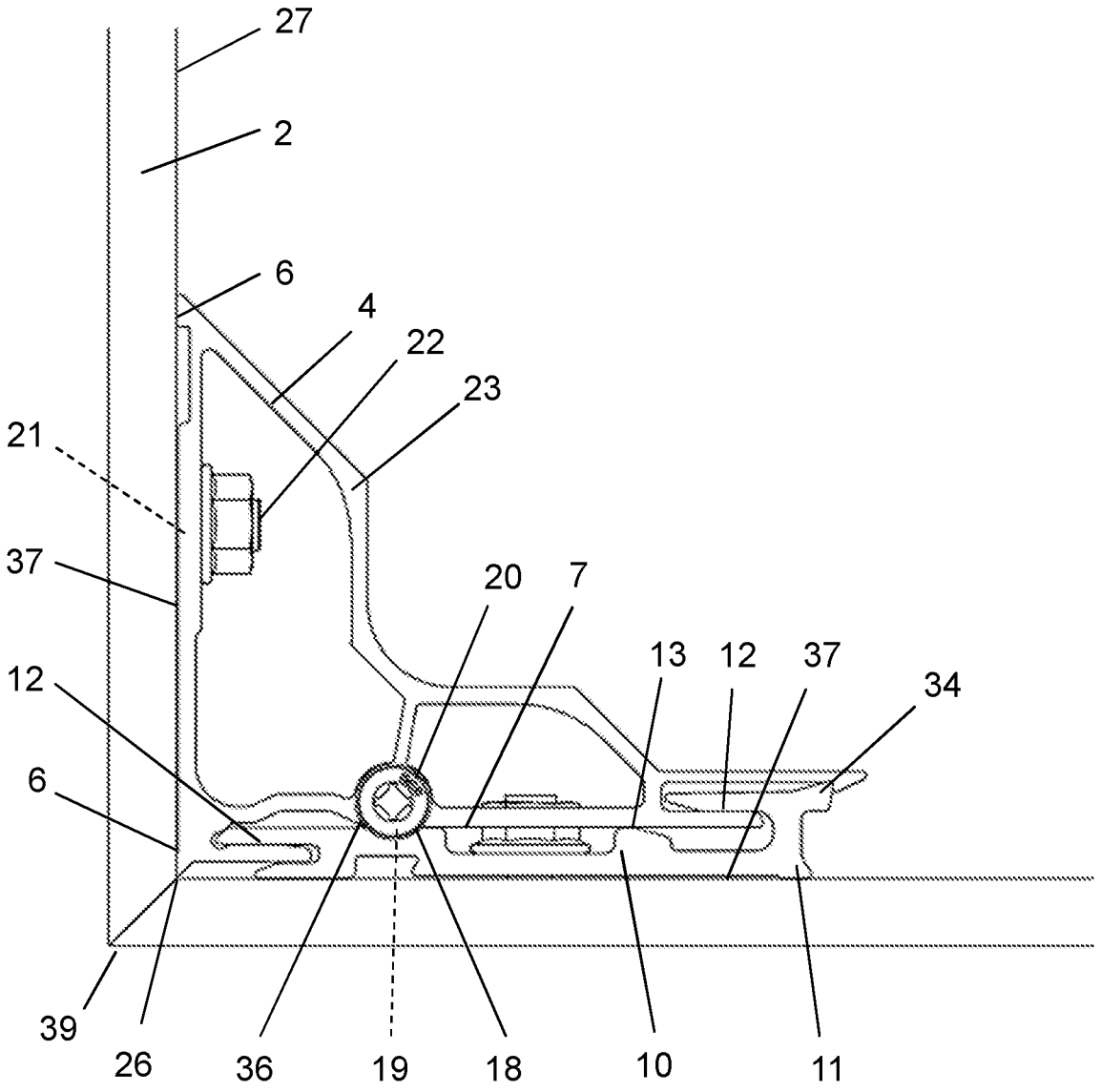
FIG. 5 is the view of FIG. 4*b* with a screw inserted.
Figure 6:
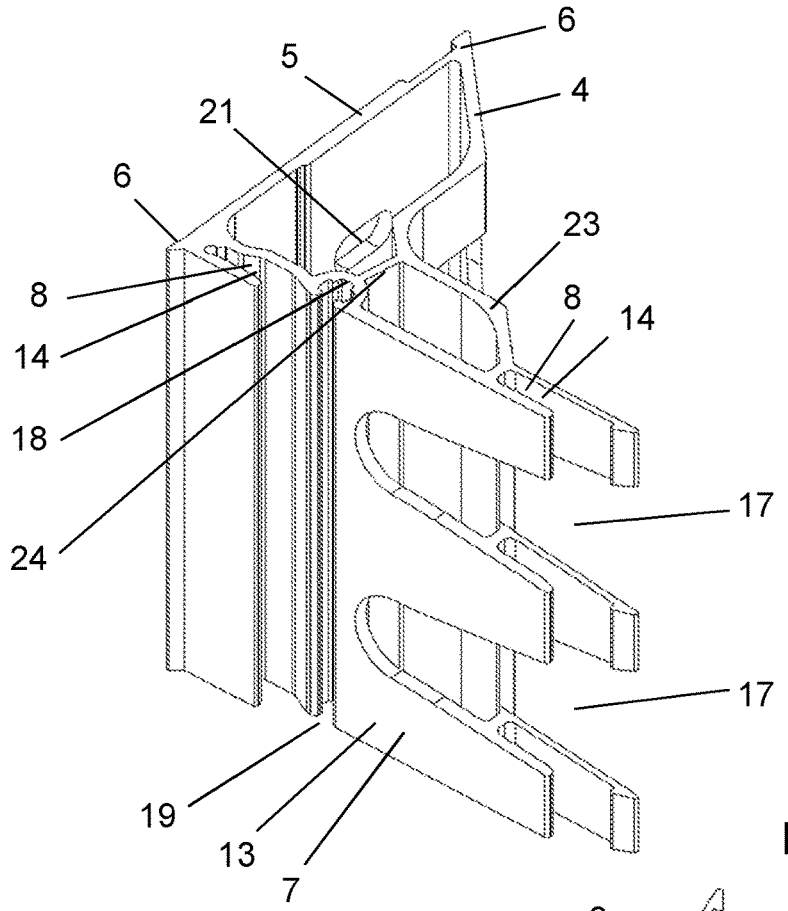
FIG. 6 is a perspective view of a first connecting element according to the preceding figures.
Figure 7:
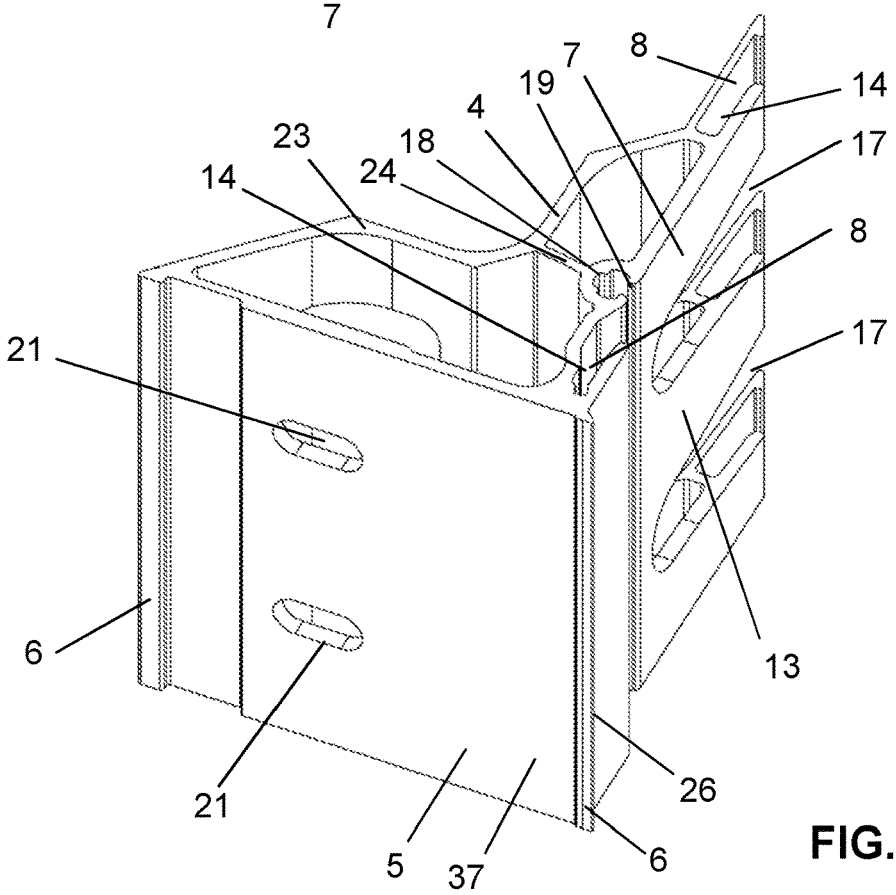
FIG. 7 is a perspective view of FIG. 6 from a different direction.
Figure 8:
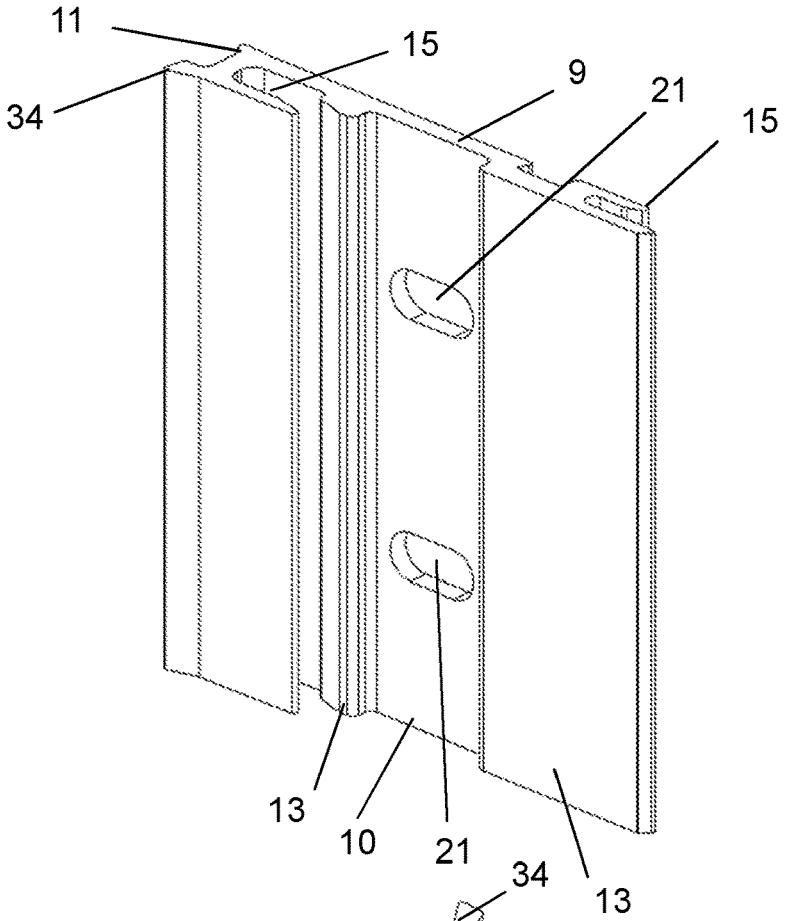
FIG. 8 is a perspective view of a second connecting element according to the preceding figures.
Figure 9:
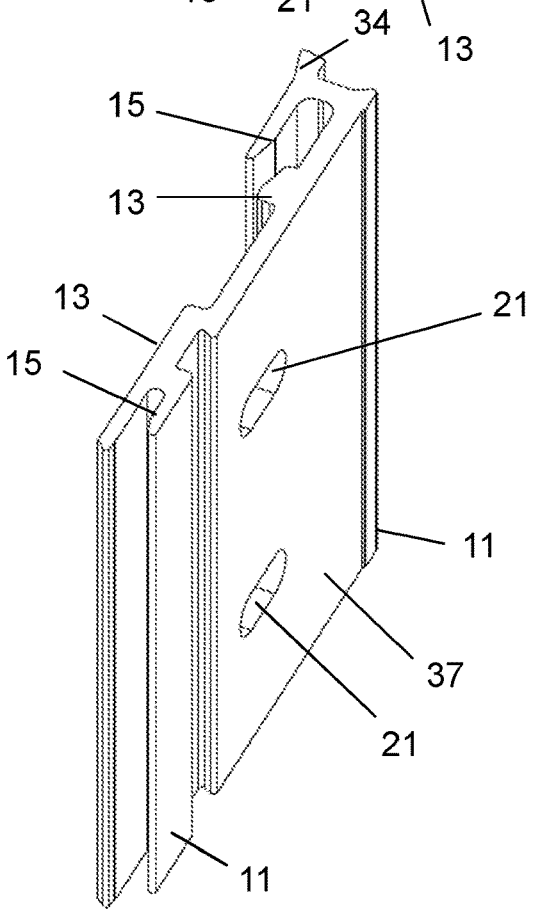
FIG. 9 is a perspective view of FIG. 8 from a different direction.

FIG. 5 shows the mechanical securing between the first connecting element 4 and the second connecting element 9. In order to mechanically secure the first connecting element 5 to the second connecting element 9, the first connecting element 4 has a screw opening 18. The screw opening 18 has an aperture 19 which is open to the second connecting element 9. A screw 20 can be screwed into the screw opening 18 and, owing to the aperture 19, the screw 20 is then located in the screw opening 18 such that the screw 20 exerts a clamping force on both connecting elements 4, 9. In the region of the aperture 21, the screw opening 18 is delimited by a wall region 36 of the second connecting element 9. As the screw 20 is screwed in, the screw 20 comes into contact with the side walls of the aperture 19 and with the wall region 36 of the second connecting element 9. A clamping force is thus provided between the two connecting elements 4, 9. The screw 20 is preferably a self-tapping metal screw.

During installation, the screw opening can also serve to receive a threaded rod, so that two panel connection systems 1 arranged adjacent to one another can be aligned relative to one another by way of the threaded rod.

It can further be seen from all the figures that the leg portion 7 is supported on the mounting portion 5 by way of a support portion 23. The support portion 23 extends at the rear, that is to say opposite the contact surface 6 and the sliding surface 13 of the first connecting element 4, between the mounting portion 5 and the leg portion 7. In the embodiment shown, the support portion 23 further comprises an intermediate leg 24, which is connected to the side wall 25 surrounding the screw opening 18. The support portion 23 can prevent the contact surface 6 from bending relative to the mounting portion 5. In the embodiment shown, the support portion 23 has a concavity 40. The concavity 40 provides a free space for a substructure, such as, for example, wooden battens or a metal structure.

Further preferred features of the two connecting elements 4, 9 will now be explained with reference to FIGS. 6 to 9.

In the embodiment shown, there is preferably more than one contact surface 6, 11 per connecting element 4, 9. On the first connecting element 4 there are two contact surfaces 6, 11 spaced apart from one another. The contact surfaces 6 are arranged in the form of strip-like contact surfaces 6. The fastening openings 21 are arranged between the two contact surfaces 6. The fastening openings 21 emerge through a surface 37 against the panel 2. The surface 37 is arranged offset with respect to the contact surfaces 6, so that the surface 37 does not come into contact with the rear side 27 of the panel 2. This has the advantage that a slightly resilient connection can be provided in the region of the surface 37. Likewise, the second connecting element 9 also has two contact surfaces 11. These two contact surfaces 11 are also arranged spaced apart from one another, and the fastening openings 21 are located between them. Here too, a surface 37 is arranged between the two contact surfaces 11, so that the same spring effect can be achieved.

Preferably, the contact surfaces 6, 11 are so arranged that they merge into one another in the region of the corner 39 of the two panels 2, 3. Particularly preferably, the contact surfaces 6, 11, located in the corner region, of the first connecting element 8 and of the second connecting element 9 are configured with a lateral edge 26. The lateral edge 26 defines an intersection line for the rear sides 27, 28 of the two panels 2, 3. The connecting element can accurately be aligned with the corresponding edge of the panel 2 by means of the lateral edge 26.

Figure 10:
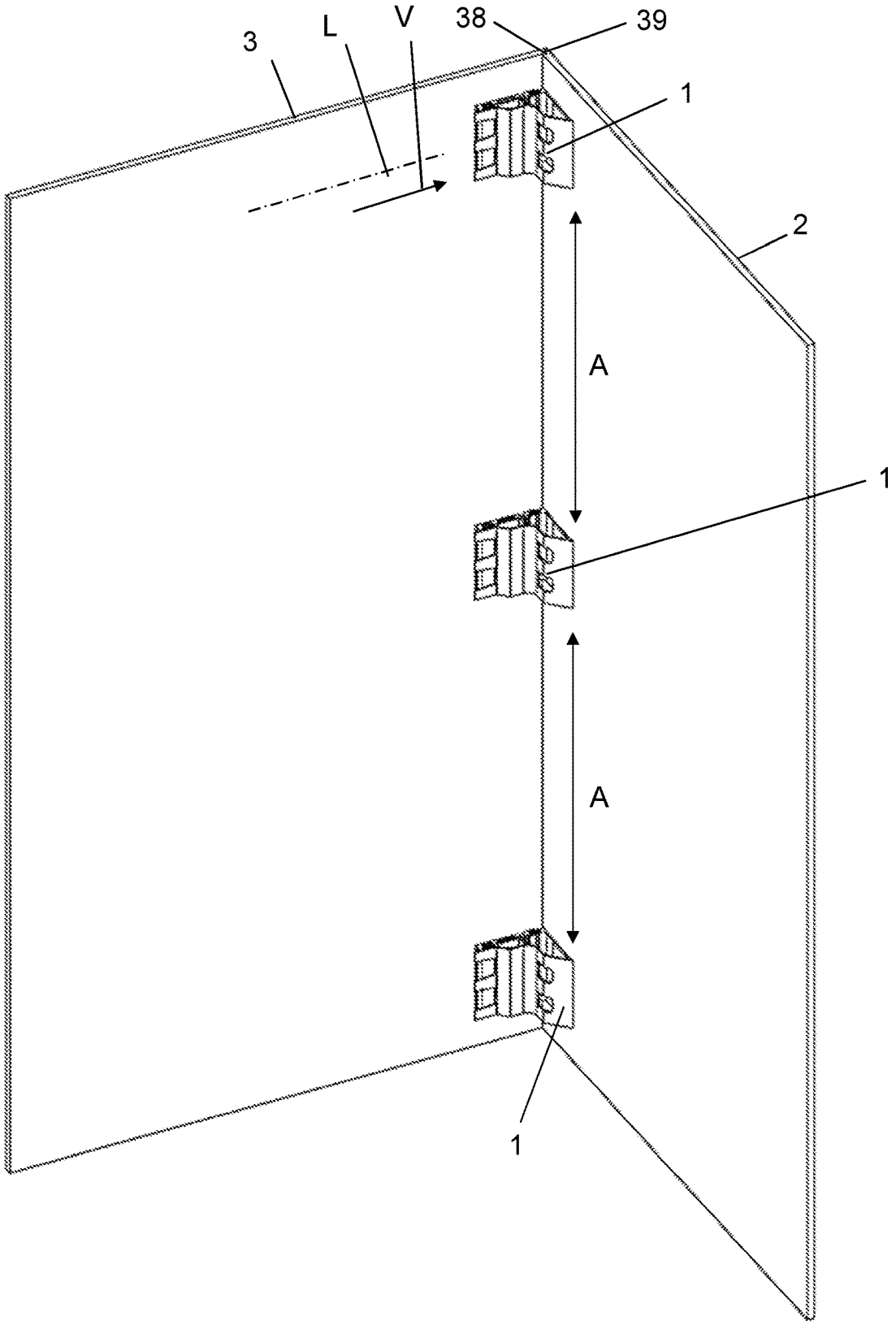
FIG. 10 is a perspective view of the panel connection system according to the invention with two panels.

In FIG. 10, the above-mentioned assembly of the two panels 2, 3 with multiple panel connection systems 1 is shown in the end position. The panel connection systems 1 are arranged spaced apart from one another by a distance A. The chosen distance A can be larger or smaller according to the stability of the panel. In the case of fiber-cement panels, the typical distance is between 20 centimeters and 100 centimeters.

FIGS. 11*a* to 14*b* show a further embodiment in different configurations. The panel connection system 1 according to this further embodiment further comprises at least one wedge element 43. The wedge element 43 is arranged between the contact surface 6, 11 and the rear side 27, 28 of the panel 2, 3 such that the contact surface 6, 11 lies against the rear side 27, 28 of the panel 2, 3 indirectly by way of the wedge element 43.

Preferably, the wedge element 43 is connected to the connecting element 4, 9 in question by way of a latching portion 44. The latching portion 44 has a base surface 48 and at least one latching hook 49. The wedge element lies against the contact surface 6, 11 of the connecting element 4, 9 in question by way of the base surface 48.

The wedge element 43 has a contact surface 45 with which the wedge element 43 lies against the rear side 27, 28 of the panel 2, 3 in question. The contact surface 45 is situated opposite the latching portion 44.

The latching portion 44, in particular the base surface 48 thereof, and said contact surface 45 are arranged at an angle to one another, so that said angle between the two panels can be achieved.

Preferably, the wedge element 43 has at least one fastening opening 47 through which the fastening screw 22 can be guided.

Figure 11C:
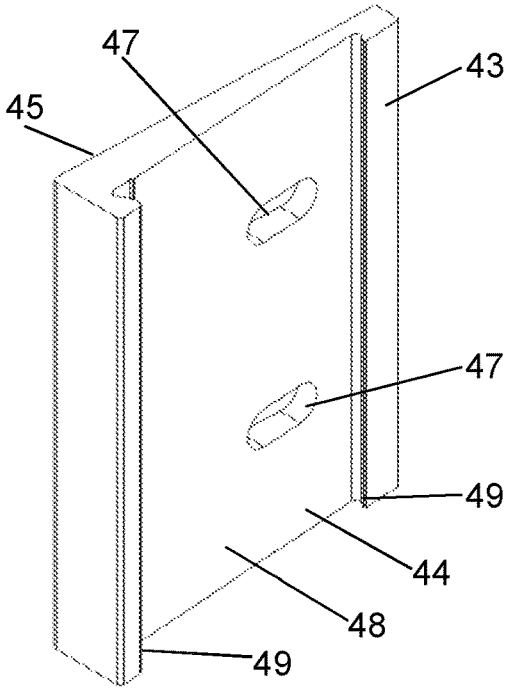
FIGS. 11*a* to 11*c* are views of a further embodiment in a first configuration.
Figure 11A:
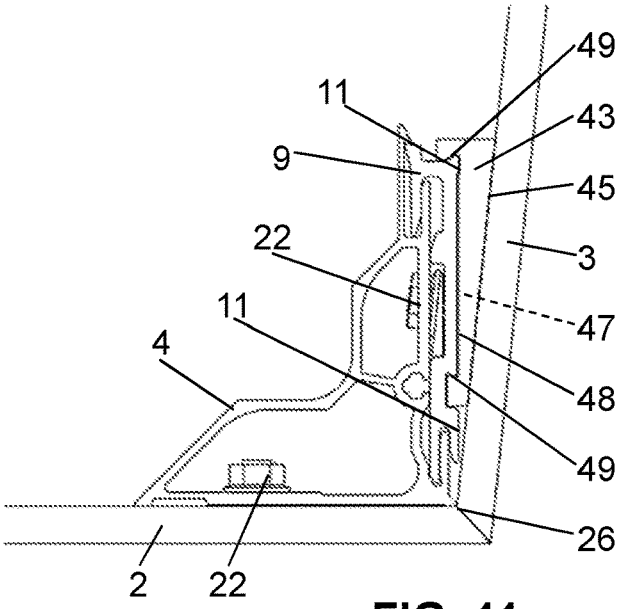
Figure 11B:
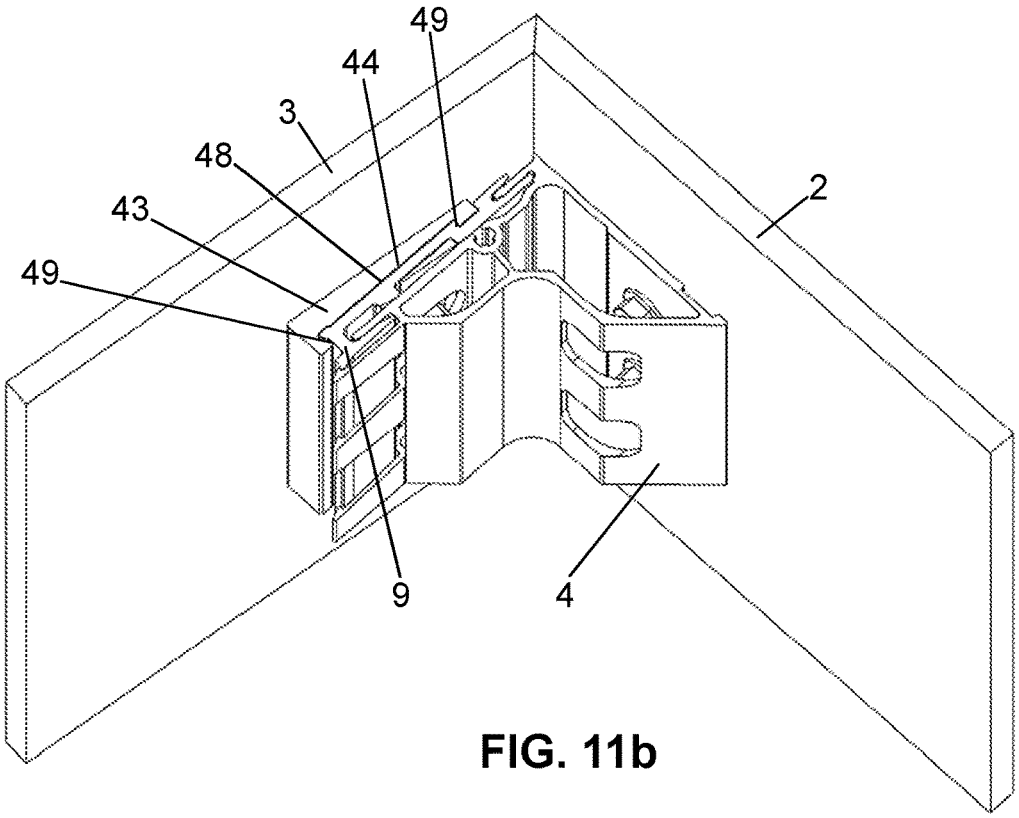

In a first configuration according to FIGS. 11*a* to 11*c*, a wedge element 43 is arranged between the second connecting element 9 and the second panel 3. The first connecting element 4 is in direct contact with the first panel 3. The wedge element 43 according to this configuration is configured such that the two panels 2, 3 are at an angle of greater than 90°, or 91°, to one another.

Figure 12C:
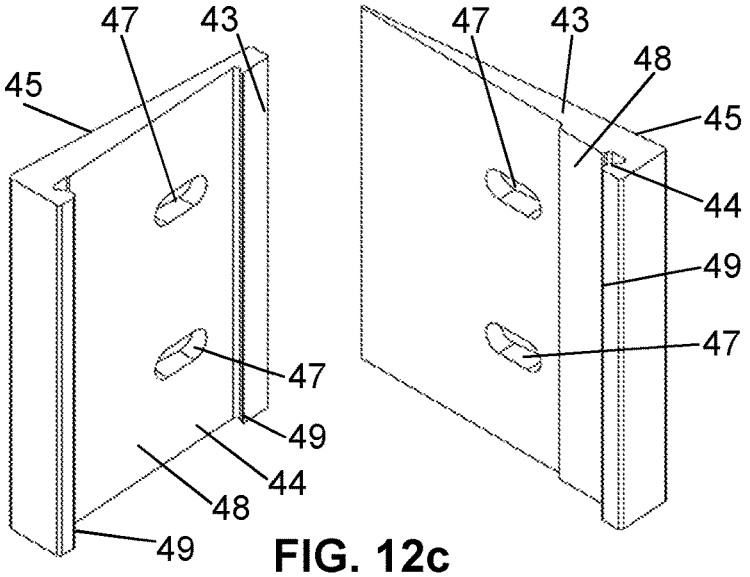
FIGS. 12*a* to 12*c* are views of the further embodiment in a second configuration.
Figure 12A:
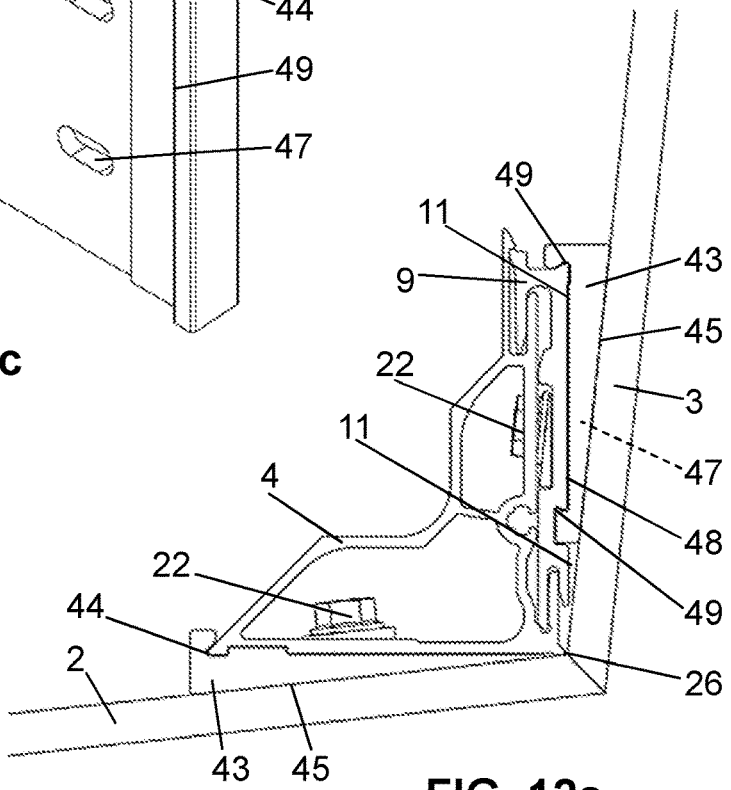
Figure 12B:
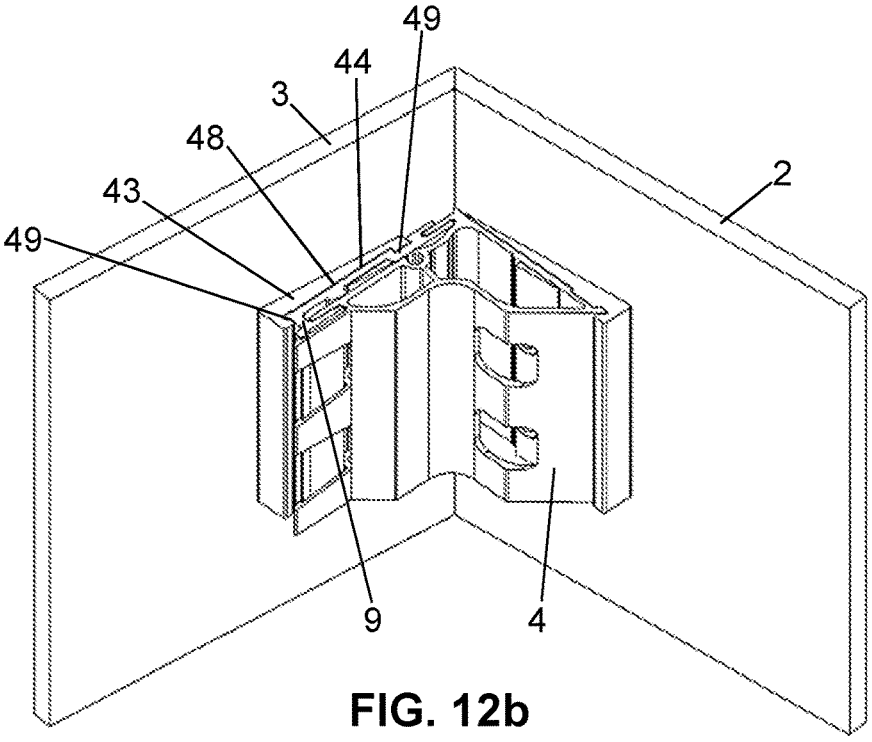

In a second configuration according to FIGS. 12*a* to 12*c*, a wedge element 43 is arranged both between the first connecting element 4 and the first panel 2 and between the second connecting element 9 and the second panel 3. The wedge element 43 according to this configuration is configured such that the two panels 2, 3 are at an angle of greater than 90°, or 91°, to one another. Compared to the first configuration, larger angles can be achieved in the second configuration.

In the first and second configurations, the wedge element 43 is configured and arranged such that the two connecting elements 4, 9 define with their lateral edges 26 the intersection line for the rear sides 27, 28 of the two panels 2, 3.

Figure 13C:
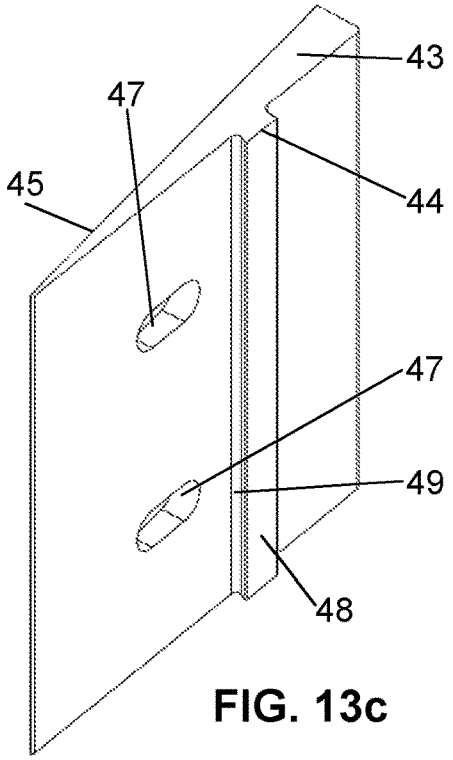
FIGS. 13*a* to 13*c* are views of the further embodiment in a third configuration.
Figure 13A:
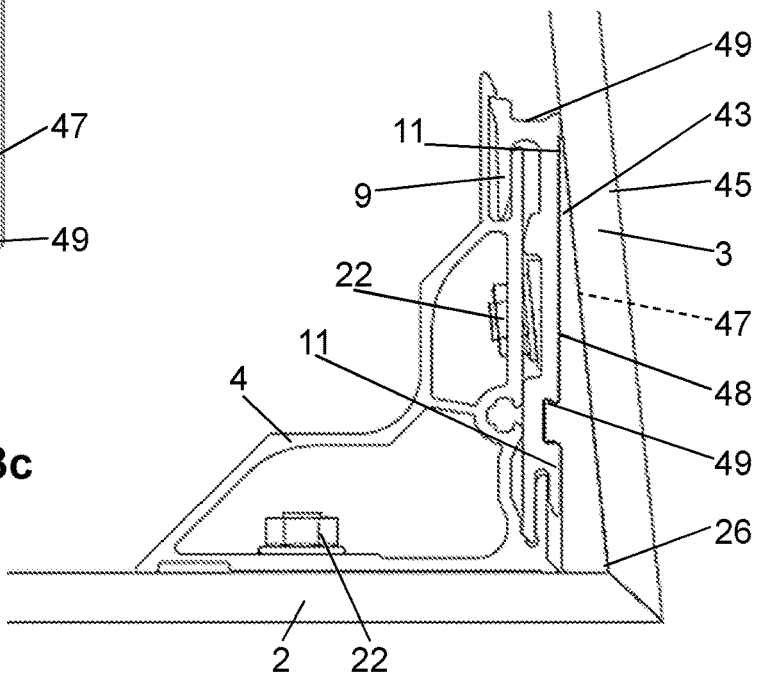
Figure 13B:
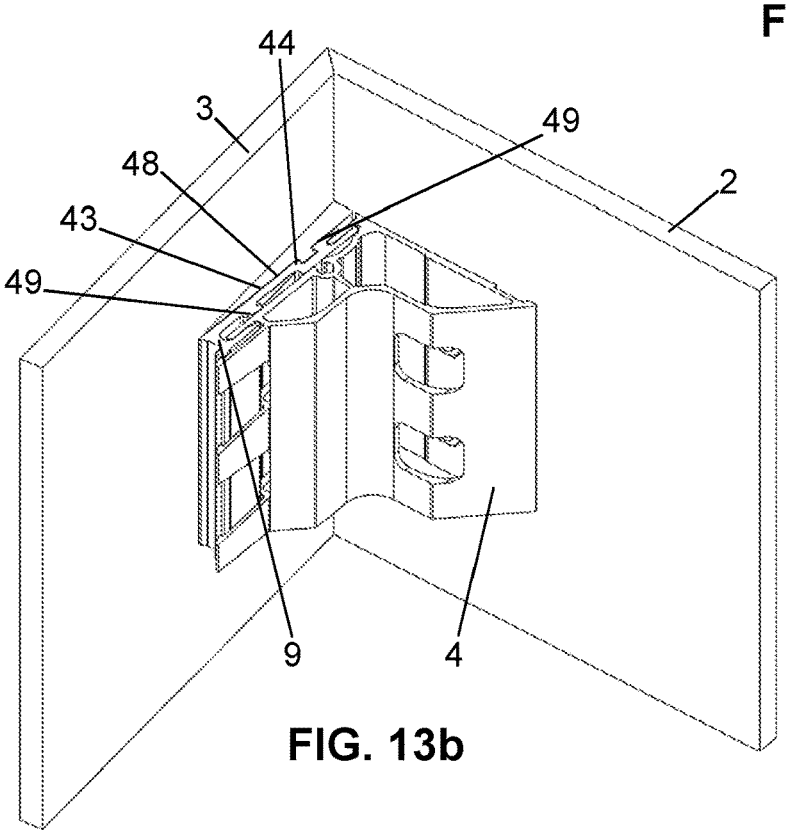

In a third configuration according to FIGS. 13*a* to 13*c*, a wedge element 43 is arranged between the second connecting element 9 and the second panel 3. The first connecting element 4 is in direct contact with the first panel 3. The wedge element 43 according to this configuration is configured such that the two panels 2, 3 are at an angle of less than 90°, or 89°, to one another.

Figure 14C:
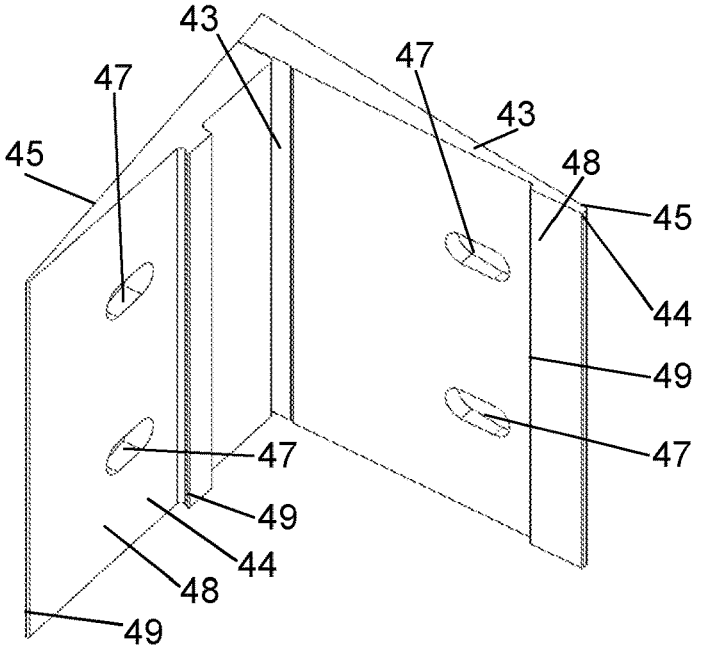
FIGS. 14*a* to 14*c* are views of the further embodiment in a fourth configuration.
Figure 14A:
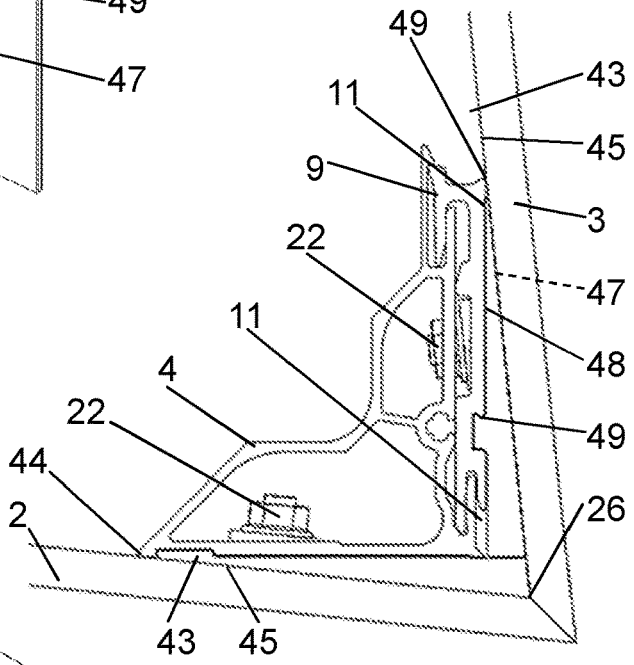
Figure 14B:
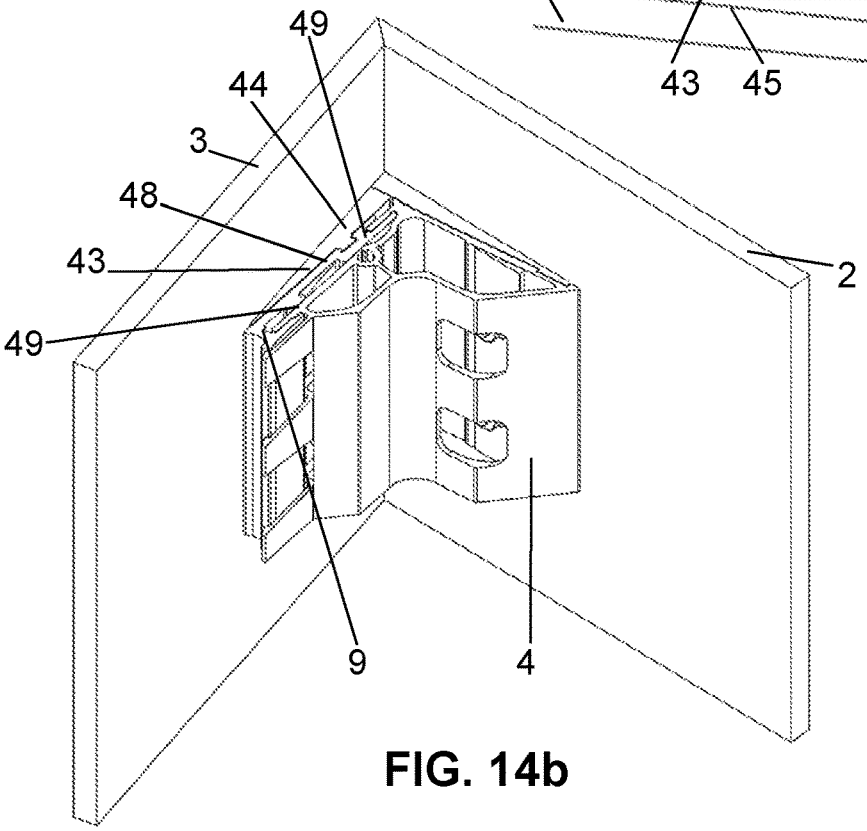

In a fourth configuration according to FIGS. 14*a* to 14*c*, a wedge element 43 is arranged both between the first connecting element 4 and the first panel 2 and between the second connecting element 9 and the second panel 3. The wedge element 43 according to this configuration is configured such that the two panels 2, 3 are at an angle of less than 90°, or 89°, to one another. Compared to the third configuration, larger angles can be achieved in the fourth configuration.

In the third and fourth configurations, the wedge element 43 is configured and arranged such that the wedge element has a lateral edge 26 which defines the intersection line for the rear sides 27, 28 of the two panels 2, 3.

Figure 15:
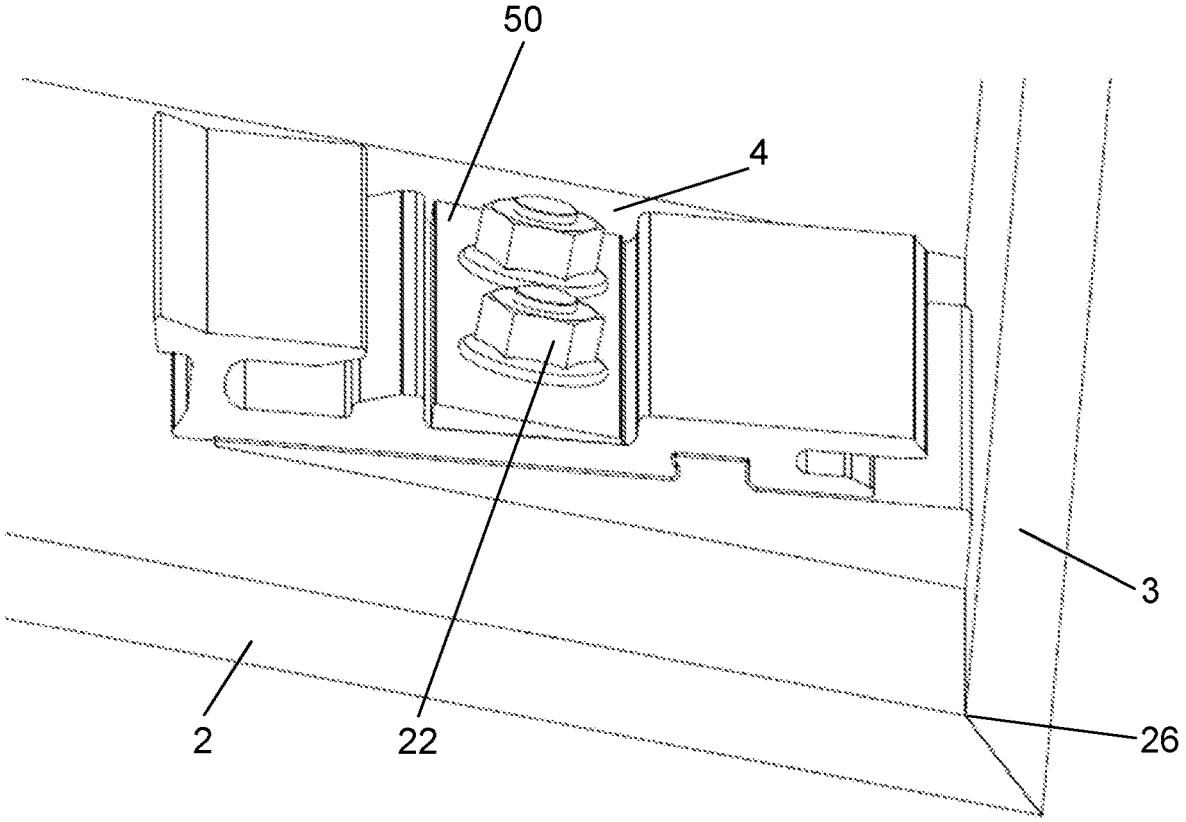
FIG. 15 is an exemplary view of one of the further embodiments.

Finally, FIG. 15 is a further view of the different configuration, wherein a compensation element 50 is inserted here for angle compensation of the angle between the contact surface of the nut and the connecting element. The compensation element 50 can be used in all the embodiments according to FIGS. 11*a* to 14*b*. Preferably, the compensation element 50 compensates for the angle such that the underside of the nut 33 is able to lie flat against the compensation element 50. The compensation element 50 is preferably made of a metallic material, in particular of aluminum, or of plastics material, in particular of polypropylene or of a recycled plastics material.

LIST OF REFERENCE SIGNS

| | |
|---|---|
| 1 | panel connection system |
| 2 | panel |
| 3 | panel |
| 4 | first connecting element |
| 5 | mounting portion |
| 6 | contact surface |
| 7 | leg portion |
| 8 | engagement structure |
| 9 | second connecting element |
| 10 | mounting portion |
| 11 | contact surface |
| 12 | engagement structure |
| 13 | sliding surface |
| 14 | receiver |
| 15 | lug |
| 16 | latching element |
| 17 | slot |
| 18 | screw opening |
| 19 | open aperture |
| 20 | screw |
| 21 | fastening openings |
| 22 | fastening screw |
| 23 | support portion |
| 24 | intermediate leg |
| 25 | side wall |
| 26 | lateral edge |
| 27 | rear side |

-continued

| | |
|---|---|
| 28 | rear side |
| 29 | end face |
| 30 | end face |
| 31 | visible side |
| 32 | visible side |
| 33 | nut |
| 34 | counter-piece |
| 35 | bevel |
| 36 | wall region |
| 37 | surface |
| 38 | defined edge |
| 39 | corner |
| 40 | concavity |
| 41 | receiver |
| 42 | lug |
| 43 | wedge element |
| 44 | latching portion |
| 45 | contact surface |
| 47 | fastening opening |
| 48 | base surface |
| 49 | latching hook |
| 50 | compensation element |
| A | distance |
| V | displacement movement |
| L | longitudinal axis |

The invention claimed is:

1. A panel connection system for the corner connection of two panels arranged inclined at an angle to one another, comprising a first connecting element comprising a first mounting portion having at least one contact surface with which the connecting element lies against one of the two panels, and a leg portion projecting from the first mounting portion in a manner inclined at an angle and having at least one first engagement structure, and a second connecting element comprising a second mounting portion having at least one contact surface with which the connecting element lies against the other of the two panels, and having at least one second engagement structure situated opposite the contact surface, wherein the at least one first engagement structure of the first connecting element is configured for engagement into the at least one second engagement structure of the second connecting element, wherein the two engagement structures are configured such that the two connecting elements can be connected together by way of a connecting movement along a longitudinal axis, which longitudinal axis is inclined at an angle to the contact surface of the first connecting element, wherein two first and two second engagement structures are provided per connecting element and thus form two pairs of engagement structures and wherein a first pair of engagement structures is arranged in a region of the transition from the first mounting portion to the leg portion, and wherein a second pair of engagement structures is arranged in a region of a free end of the leg portion.

2. The panel connection system as claimed in claim 1, wherein each of the two connecting elements has at least one sliding surface in a region of the engagement structures, wherein the sliding surfaces are arranged such that the two connecting elements are in contact with one another by way of the sliding surfaces during connection.

3. The panel connection system as claimed in claim 1, wherein one of the engagement structures is in the form of a receiver, and wherein another of the engagement structures is in the form of a lug, wherein the lug can be inserted into the receiver along the longitudinal axis.

4. The panel connection system as claimed in claim 3, wherein the lug engages into the receiver substantially without play.

5. The panel connection system as claimed in claim 1, wherein one of the engagement structures is in the form of a receiver, and wherein another of the engagement structures is in the form of a lug, wherein the lug can be inserted into the receiver along the longitudinal axis, and wherein the receiver and/or the lug has a latching element which permits mechanically fixed latching of the two interengaging engagement structures.

6. The panel connection system as claimed in claim 5, wherein the engagement structure having the latching element is interrupted by at least one slot extending in the longitudinal direction; and/or wherein the lug engages into the receiver substantially without play.

7. The panel connection system as claimed in claim 1, wherein one of the two connecting elements has a screw opening which has an aperture that is open to the other connecting element, wherein a screw can be screwed into the screw opening, such that the screw exerts a clamping force on both connecting elements.

8. The panel connection system as claimed in claim 1, wherein at least one of said mounting portions has at least one fastening opening through which a fastening screw connected to the panel can be guided, such that the connecting element can be fixedly connected to said panel.

9. The panel connection system as claimed in claim 1, wherein at least one of said mounting portions has at least one fastening opening through which a corresponding fastening screw connected to the panel can be guided, such that the connecting element can be fixedly connected to said panel and wherein the leg portion has one slot per fastening screw, wherein each slot creates a passage region for the corresponding fastening screw on connection of the two connecting elements.

10. The panel connection system as claimed in claim 1, wherein the leg portion is supported on the first mounting portion and/or on the second mounting portion by way of a support portion, wherein the support portion is arranged opposite the contact surface and the engagement structure.

11. The panel connection system as claimed in claim 1, wherein one of the two connecting elements has a screw opening which has an aperture that is open to the other connecting element, wherein a screw can be screwed into the screw opening, such that the screw exerts a clamping force on both connecting elements, wherein the leg portion is supported on the first mounting portion and/or on the second mounting portion by way of a support portion, wherein the support portion is arranged opposite the contact surface and the engagement structure, and wherein the support portion is connected by means of an intermediate leg to a side wall surrounding the screw opening.

12. The panel connection system as claimed in claim 1, wherein there are two contact surfaces arranged spaced apart from one another per connecting element.

13. The panel connection system as claimed claim 1, wherein one of the contact surfaces of the first connecting element and/or of the second connecting element is configured with a lateral edge, wherein, in an assembled state of the panel connection system, the lateral edge aligns with a joint between rear sides of the two panels.

14. The panel connection system as claimed in claim 1, wherein an angle between the contact surface of the first connecting element and the contact surface of the second connecting element is substantially 90°, such that, when the connecting elements lie directly against the respective panel, the two panels are arranged at a right angle to one another.

15. The panel connection system as claimed in claim 1, wherein the panel connection system further comprises at least one wedge element which can be arranged on at least one of the mentioned contact surfaces and at least one of the rear sides of the panel such that the at least one contact surface lies against the rear side of the panel indirectly by way of the wedge element and the panels are inclined at an angle to one another that is other than a right angle.

16. The panel connection system as claimed in claim 15, wherein the wedge element has a latching portion with which the wedge element can be connected to the connecting element by way of a latching connection; and/or the wedge element has a contact surface with which the wedge element lies against the panel; and/or the wedge element is made of a metal, such as aluminum, or a plastics material, such as polypropylene; and/or the mentioned angle is between 91° and 102° or between 78° and 89°.

17. An assembly comprising at least one panel connection system and two panels arranged inclined at an angle to one another, wherein said panel connection system is provided for the corner connection of the two panels and said panel connection system comprises a first connecting element comprising a first mounting portion having at least one contact surface with which the connecting element lies against one of the two panels, and a leg portion projecting from the first mounting portion in a manner inclined at an angle and having at least one first engagement structure, and a second connecting element comprising a second mounting portion having at least one contact surface with which the connecting element lies against the other of the two panels, and having at least one second engagement structure situated opposite the contact surface, wherein the at least one first engagement structure of the first connecting element is configured for engagement into the at least one second engagement structure of the second connecting element, wherein the two engagement structures are configured such that the two connecting elements can be connected together by way of a connecting movement along a longitudinal axis, which longitudinal axis is inclined at an angle to the contact surface of the first connecting element, wherein the first connecting element is mounted on a rear side of one panel and the second connecting element is mounted on a rear side of the other panel, wherein two first and two second engagement structures are provided per connecting element and thus form two pairs of engagement structures and wherein a first pair of engagement structures is arranged in a region of the transition from the first mounting portion to the leg portion, and wherein a second pair of engagement structures is arranged in a region of a free end of the leg portion.

18. A method for installing the assembly as claimed in claim 17, comprising providing the at least one panel connection system and the two panels, and wherein, in a first step, the first and second connecting elements are connected to the respective panel and wherein, in a subsequent step, the two panels with the connecting elements are moved relative to one another by way of a connecting movement along a longitudinal axis, such that the at least one first engagement structure of the first connecting element engages into the at least one second engagement structure of the second connecting element.

19. An assembly comprising at least one panel connection system and two panels arranged inclined at an angle to one another, wherein said panel connection system is provided for the corner connection of the two panels and said panel connection system comprises a first connecting element comprising a mounting first portion having at least one contact surface with which the connecting element lies against one of the two panels, and a leg portion projecting from the first mounting portion in a manner inclined at an angle and having at least one first engagement structure, and a second connecting element comprising a second mounting portion having at least one contact surface with which the connecting element lies against the other of the two panels, and having at least one second engagement structure situated opposite the contact surface, wherein the at least one first engagement structure of the first connecting element is configured for engagement into the at least one second engagement structure of the second connecting element, wherein the two engagement structures are configured such that the two connecting elements can be connected together by way of a connecting movement along a longitudinal axis, which longitudinal axis is inclined at an angle to the contact surface of the first connecting element, wherein the first connecting element is mounted on a rear side of one panel and the second connecting element is mounted on a rear side of the other panel, wherein the two panels can be brought into contact with one another by way of end faces, wherein the end faces are in the form of mitered surfaces, wherein two first and two second engagement structures are provided per connecting element and thus form two pairs of engagement structures and wherein a first pair of engagement structures is arranged in a region of the transition from the first mounting portion to the leg portion, and wherein a second pair of engagement structures is arranged in a region of a free end of the leg portion.

20. A method for installing the assembly as claimed in claim 19, comprising providing the at least one panel connection system and the two panels, and wherein, in a first step, the first and second connecting elements are connected to the respective panel and wherein, in a subsequent step, the two panels with the connecting elements are moved relative to one another by way of a connecting movement along a longitudinal axis, such that the at least one first engagement structure of the first connecting element engages into the at least one second engagement structure of the second connecting element.

* * * * *